US005232763A

United States Patent [19]

Holbek et al.

[11] Patent Number: 5,232,763

[45] Date of Patent: Aug. 3, 1993

[54] BITUMINOUS COATING MATERIAL AND A PROCESS FOR PRODUCING A BITUMINOUS COATING ON A SUPPORT

[75] Inventors: John Holbek, Lyngby; Kim Worre, Frederiksberg; Bjarne K. Beck, Søborg, all of Denmark

[73] Assignee: A/S Jens Villadsens Fabriker, Herlev, Denmark

[21] Appl. No.: 781,126

[22] PCT Filed: Jul. 10, 1990

[86] PCT No.: PCT/DK90/00179

§ 371 Date: Jan. 7, 1992

§ 102(e) Date: Jan. 7, 1992

[87] PCT Pub. No.: WO91/00945

PCT Pub. Date: Jan. 24, 1991

[30] Foreign Application Priority Data

Jul. 10, 1989 [DK] Denmark ..... 3401/89

[51] Int. Cl.[5] ..... B32B 3/28; D06N 7/04; B29C 47/00

[52] U.S. Cl. ..... 428/167; 428/141; 428/161; 428/163; 428/172; 428/212; 428/346; 428/352; 428/389; 156/176; 156/196; 156/209; 156/242; 156/244.25; 156/257; 156/305; 156/337; 264/175; 264/241; 264/299; 264/319; 264/503; 264/521

[58] Field of Search ..... 428/156, 167, 172, 40, 428/68, 120, 141, 161, 163, 219, 212, 346, 352, 489; 156/155, 176, 196, 209, 228, 242, 244.25, 257, 305, 337; 264/503, 521, 175, 241, 299, 319

[56] References Cited

U.S. PATENT DOCUMENTS 4,636,417 1/1987 Rasmussen ..... 428/91

FOREIGN PATENT DOCUMENTS 150586 3/1987 Denmark .
0271727 6/1988 European Pat. Off. .
2544361 10/1984 France .
1497724 1/1978 United Kingdom .
1511060 5/1978 United Kingdom .
2146270 4/1985 United Kingdom .

*Primary Examiner*—Donald J. Loney
*Attorney, Agent, or Firm*—Watson, Cole, Grindle & Watson

[57] ABSTRACT

A bituminous sheet or web coating material (1) is on the one side provided with a heat activatable adhesive layer (3) optionally covered by a plastic film (5), wherein the adhesive layer is provided with a pattern of close grooves (4) with intermediate unbroken ridges, and a process for forming a coating on a support is performed by heating such coating material (1) to decomposition of said plastic film (5) and activation of the adhesive layer (3), the activated adhesive layer (3) being pressed against the support, e.g. a roof.

9 Claims, 1 Drawing Sheet

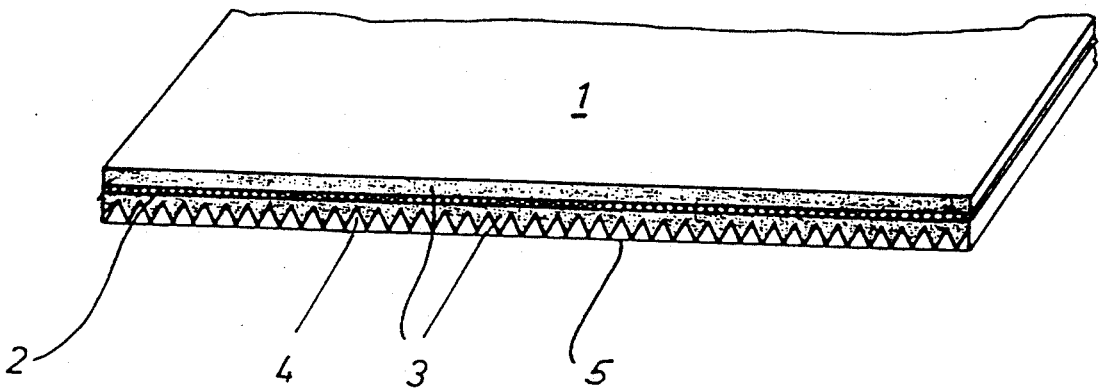
1
2
4
3
5

BITUMINOUS COATING MATERIAL AND A PROCESS FOR PRODUCING A BITUMINOUS COATING ON A SUPPORT

BACKGROUND OF THE INVENTION

Present invention relates to a bituminous coating sheet material provided on one side with a heat-activatable adhesive layer that is optionally coated with a plastic film.

In particular, the invention relates to a bituminous sheet-formed coating material for the formation of a roof covering. It is known to produce roofings by using roofing felt sheets, i.e., bituminous felt lengths, which are coated with a plastic film of, e.g., polyethylene or polypropylene, having a thickness of about 10 μm.

The main function of the plastic film is to prevent adjacent parts of the roofing felt sheets from sticking to each other when the sheets are stored and transported in rolls. The heating of the roofing felt sheets is typically carried out by use of propane gas burners.

When the flame, which has a typical temperature of 1000°-1300° C., is directed towards the plastic film-coated adhesive layer, the plastic film decomposes and burns away and the adhesive layer is activated. However, the use of such gas burners is associated with a certain fire hazard as sometimes the support or other parts of the roof construction may catch fire.

The noted flame heating is further associated with the drawback that the decomposition of the plastic film is often incomplete and therefore areas remain where the adhesive layer is covered with film residues and, as a consequence, the desired adhesion is not obtained. DK patent publication No. 150 586 B discloses a process for producing a bituminous coating on a support, provided with pressure equalization zones. In this known process a bituminous sheet material which, on the adhesive side, is provided with rows of projections of an adhesive consisting of a mixture of bitumen and a thermoplastic elastomer, is adhered to the support. These rows are typically spaced apart about 30 mm and the projections have a maximum length of 50 mm, a typical width of 15 mm and a height of 1-3 mm.

The formation of these projections on the bituminous sheet material is effected by producing initially a sand-strewn bituminous sheet material and then rolling thereon the adhesive in its melted state using a pattern embossing roll.

The known material is appropriate for the formation of a coating with pressure equalization zones, but it is unsuitable for the formation of a fully adhered coating as, although the adhesive is heated enough for the projection to spread, it is not possible to obtain a uniform adhesive layer. Moreover, the known material is associated with the drawback that it is difficult to obtain complete removal of the film described above, as a part of the film remains on top of the projections.

GB 2.146.270 A discloses a laminated roofing coating for application in a cold process and comprising a fibrous layer optionally impregnated with bitumen, a bituminous layer laminated on one side of the fibrous layer, a synthetic resin layer laminated on the bituminous layer for protection thereof, an adhesive layer partially coated on the synthetic resin layer, and a release layer laminated on the adhesive layer.

The partially covering adhesive layer may be applied the synthetic resin layer in the form of spots, lines, stripes, or bands.

FR2.544.361 A3 discloses a roofing coasting comprising a bituminous layer wherein a connected system of longitudinal and transverse grooves are formed, and a polyethylene film provided on the side of the bituminous layer comprising the groove system. The groove system serves to secure pressure equalization. The roofing coating may comprise one or more supports.

The known roofing material is manufactured by applying the plastic film onto a plane bituminous layer, and subsequently forming the grooving in both the film and the bituminous layer simultaneously. This grooving process results in a material, which is unsuitable for the formation of a fully adhered coating, since it is difficult to obtain complete removal of the film from the bituminous layer.

SUMMARY OF THE PRESENT INVENTION

The coating material according to the invention is characterized in that a pattern of parallel grooves and intermediate unbroken ridges is provided in the adhesive layer, the distance between adjacent grooves not exceeding 10 mm.

The coating material according to the invention is surprisingly found to present a variety of technical advantages.

Firstly, such a material may be used not only for forming a fully adhered coating on a support, viz. by heating all parts of the groove-patterned adhesive layer, but also for forming a coating which prevents humidity and/or air under pressure in entrapped zones from accumulating during the application process. The latter is obtained by heating the adhesive layer in such a manner that it is adhered to the support in separate zones, the grooves of the nonadhered zones serving as pressure equalization channels.

As compared to the coating material disclosed in DK patent publication No. 150 586, the material according to the invention is moreover simpler and thus less expensive to produce, the production thereof not requiring the application of an additional adhesive layer of a particular composition.

Furthermore, the groove pattern in the adhesive layer permits a vastly enhanced heat exchange between the hot gas stream on the one side and the plastic film and the adhesive layer on the other side when the removal of a plastic film fixed to the adhesive layer is to be carried out prior to adhering the material to a support. The improved heat exchange causes the removal of the plastic film to be substantially faster and more efficient and the adhesive layer to be more efficiently activated than when the known coating material disclosed above is used.

The practical consequence is that when using a propane gas flame for heating the energy requirement is reduced.

In practice the reduced energy requirement means that it is possible to increase the laying out rate of roofing felt having an adhesive layer, which consists primarily of bitumen, from about 1.0 m/min to about 1.4 m/min, which means that the energy consumption per m is reduced from about 61 g g gas/m to about 45 g gas/m.

When laying out roofing felt with a 15 cm overlap, experiments in practice have proved it possible to increase the rate from 0.8 m/min to about 1.5 m/min, which means that the energy consumption is reduced from 63 W/m to 33 W/m.

The surprisingly improved heat exchange is also expressed by the fact that, when carrying out the process according to the invention, flameless heating of the plastic film and the adhesive layer may be carried out, the flameless heating, which may, e.g., be be carried out with an air stream having a temperature of from 200° to 800° C., having surprisingly proved to effect the complete removal of the plastic film and the activation of an adhesive layer of bitumen.

The use of such a flameless gas stream of a relatively low temperature eliminates substantially fire hazards.

The distance between the grooves in the adhesive layer is, as stated above, no more than 10 mm, and according to a preferred embodiment the distance is between 1 and 5 mm, which means that the grooves are situated relatively closely to each other. The height of the projections as measured from the bottom of the grooves is preferably comprised within the range of from 0.5 to 6 mm, and particularly preferred within a range of from 1 to 3 mm.

Preferably, the grooves in the adhesive layer extend in the longitudinal direction of the sheet material and thus they can be produced by combing of the adhesive layer in connection with the production of the sheet material when the adhesive layer is still hot and viscous.

However, these grooves may also extend perpendicularly to this direction or at any other angle relative to the longitudinal direction.

The adhesive layer may consist of usual adhesive asphalt (bitumen), but it may also contain a self-adhesive polymer or resin.

The plastic film may, e.g., have a thickness of from about 10 μm, but in practice films with thicknesses of from 3 to 30 μm can be used.

The invention further relates to a process for producing a waterproof, bituminous coating on a support and in particular a roof covering, wherein a sheet coating material, which, on the one side is provided with a heat activatable adhesive layer covered by a plastic film, is heated to decompose the plastic film and to activate the adhesive layer and the activated adhesive layer is pressed against the support, the process being characterized in that the material according to the invention described above is used as the coating material.

A particularly preferred embodiment of the process according to the invention is characterized in that the heating is carried out with a flameless hot air stream.

Such air stream may, e.g., be produced by electrically heating a stream of atmospheric air.

The heating may also be carried out by heat radiation, e.g., by use of internally heated heating means or by IR heat radiation.

DESCRIPTION OF THE FIGURE

The invention will be further described in greater detail with reference to the accompanying figure, which represents a schematical perspective view of a preferred embodiment of a roofing sheet according to the invention.

DESCRIPTION OF PREFERRED EMBODIMENT

In the FIG. 1 denotes a roofing sheet comprising a felt layer 2 and an adhesive layer 3. The adhesive layer 3 is on the inside of the sheet 1 provided with grooves 4 which extend in the longitudinal direction of the sheet material 1. The grooved adhesive layer 3 is coated with a plastic film 5 which abuts substantially only the tops of the ridges between the grooves 4.

We claim:

1. A bituminous sheet coating material which comprises a bituminous layer having opposite sides and a heat-activatable adhesive layer covering one of said opposite sides, said adhesive layer providing a pattern of parallel grooves and intermediate unbroken ridges, said grooves being spaced by no more than 10 mm.

2. A coating material according to claim 1, wherein the distance between adjacent grooves is between 1 and 5 mm.

3. A coating material according to claim 1, wherein the height of the ridges as measured from the bottom of the grooves is from 0.5 to 6 mm.

4. A coating material according to claim 3, wherein the height of the grooves is from 1 to 3 mm.

5. A coating material according to claim 1, wherein the grooves extend in a longitudinal direction of the sheet material.

6. A coating material according to claim 1, wherein said adhesive layer is coated by a plastic film having a thickness of from 3 to 30 um.

7. A process for the production of a bituminous coating on a support comprising the steps of heating a sheet coating material provided with a heat activatable adhesive layer covered by a plastic film to decompose the plastic film and to activate the adhesive layer, and pressing the activated adhesive layer against the support, wherein the coating sheet material in which the adhesive layer is provided has a pattern of parallel grooves and intermediate unbroken ridges, the distance between adjacent grooves not exceeding 10 mm.

8. A process according to claim 7, wherein the distance between adjacent grooves is from 1 to 5 mm.

9. A process according to claim 7, wherein the plastic film and the adhesive layer are heated with a flameless hot air stream.

* * * * *